US010307897B2

(12) United States Patent
Stone et al.

(10) Patent No.: US 10,307,897 B2
(45) Date of Patent: Jun. 4, 2019

(54) DOUBLE SOCKET TELESCOPIC TORQUE REACTOR

(71) Applicant: The Boeing Company, Chicago, IL (US)

(72) Inventors: Paul R. Stone, Federal Way, WA (US); Michael W. Luce, Puyallup, WA (US)

(73) Assignee: The Boeing Company, Chicago, IL (US)

( * ) Notice: Subject to any disclaimer, the term of this patent is extended or adjusted under 35 U.S.C. 154(b) by 432 days.

(21) Appl. No.: 15/007,032

(22) Filed: Jan. 26, 2016

(65) Prior Publication Data

US 2017/0209992 A1 Jul. 27, 2017

(51) Int. Cl.
*B25B 23/00* (2006.01)

(52) U.S. Cl.
CPC ..... *B25B 23/0085* (2013.01)

(58) Field of Classification Search
CPC ..... B25B 23/0085; B25B 23/00; B25B 13/48; B25B 23/10; B25B 9/00
See application file for complete search history.

(56) References Cited

U.S. PATENT DOCUMENTS

| | | | | |
|---|---|---|---|---|
| 3,905,254 | A * | 9/1975 | Palatnick | B23P 19/069 81/57.22 |
| 5,528,964 | A * | 6/1996 | Smith, Jr. | B25B 17/02 81/177.2 |
| 6,941,840 | B1 * | 9/2005 | Harris | B25B 23/0085 81/13 |
| 7,896,595 | B2 | 3/2011 | Case | |
| 2013/0074315 | A1 | 3/2013 | Slocum et al. | |

* cited by examiner

*Primary Examiner* — Robert J Scruggs
(74) *Attorney, Agent, or Firm* — Felix L. Fischer

(57) ABSTRACT

A torque reactor employs a first socket with a first drive element engaging the first socket and a second socket with a second drive element engaging the second socket. The first drive element has a first receiving channel and the second drive element has a second receiving channel. A shaft is received in the first receiving channel second receiving channel. A first engagement mechanism secures the shaft in the first receiving channel and a second engagement mechanism secures the shaft in the second receiving channel.

20 Claims, 13 Drawing Sheets

DOUBLE SOCKET TELESCOPIC TORQUE REACTOR

BACKGROUND INFORMATION

Field

Embodiments of the disclosure relate generally to devices for torqueing fasteners and more particularly to a system employing two sockets commonly supported and releasably spaced on an interconnecting shaft to engage two fasteners whereby torque induced by tightening one fastener is reacted in the second fastener and relief of induced load between the sockets is enabled by releasing one or both sockets on the shaft.

Background

Many fasteners in aircraft structures require very high torque, in excess of 2000 inch pounds. Typically one side (either the nut or bolt side) of the fasteners are in confined spaces. Mechanics can use drivers and torque multipliers on an exposed side, along with torque reaction arms to drive the fasteners. The opposite side must also have a wrench (or similar tool) engaged to prevent rotation so the required torque may be achieved. Mechanics in current applications use a hand held wrench to prevent the nut from rotating, without other mechanical assistance. This approach may be impaired by limited access to the fastener to be restrained. Additionally, if the wrench slips, soft tissue injuries or damage to the aircraft structure may be incurred. Some devices react the torque by joining two sockets together rigidly and use an adjacent fastener to react the torque. These structures are not satisfactory because after the fasteners have been driven to the required torque, the preload induced in the sockets is so high they cannot be removed from the fasteners.

It is therefore desirable to provide a method and tool for operation with limited access to allow reaction of torque applied to fasteners during assembly. It is further desirable that the system be releasable to relieve induced preload and allow removal of the tool.

SUMMARY

Embodiments disclosed herein provide a torque reactor having a first socket with a first drive element engaging the first socket and a second socket with a second drive element engaging the second socket. The first drive element has a first receiving channel and the second drive element has a second receiving channel. A shaft is received in the first receiving channel and the second receiving channel. A first engagement mechanism secures the shaft in the first receiving channel and a second engagement mechanism secures the shaft in the second receiving channel.

The embodiments allow a method for reacting torque during torqueing of a fastener. Restraining elements in at least one of a first drive element and a second drive element are released from a shaft and the drive elements are longitudinally adjusted on the shaft to be equivalent to spacing of fasteners onto which first and second sockets are to be placed. The first and second sockets are placed on a fastener and an adjacent fastener. The restraining elements are secured in the first and second drive elements constraining the shaft in the drive elements. The fastener is then torqued and the torque is transmitted in the first socket through the first drive element and shaft to the second drive element and second socket secured to the adjacent fastener employing the arm length of the shaft between the drive elements for mechanical advantage to react the torque. Upon completion of torqueing the fastener, the restraining elements are released thereby releasing any preload established in the sockets.

The features, functions, and advantages that have been discussed can be achieved independently in various embodiments of the present disclosure or may be combined in yet other embodiments, further details of which can be seen with reference to the following description and drawings.

DETAILED DESCRIPTION

Embodiments disclosed herein provide embodiments employing two sockets receivable on adjacent fasteners to react the torque for tightening at least one of the fasteners. A square drive element having a slot is attached to each socket. A shaft is fitted into the slot of each drive element. There is clearance between the shaft and the slot to allow the square drive elements to be adjusted along the length of the shaft. An engagement mechanism is tightened against the shaft to achieve a rigid connection between the sockets. By releasing the engagement mechanism, the drive elements may slide along the shaft (telescope) to accommodate any spacing between fasteners and, after torqueing of the fastener, any preload imposed, which might create binding of the socket on the fastener, may be released. Each drive element also has a cap over the slot to restrain the shaft in the drive elements.

Figure 1A:
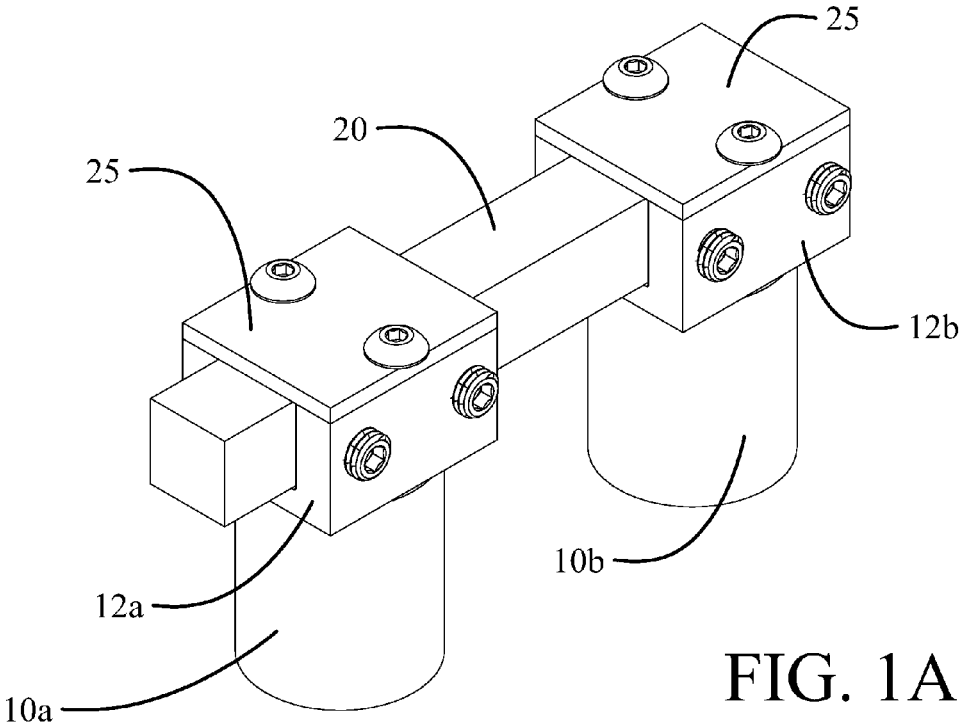
FIG. 1A is an upper pictorial depiction of a first embodiment of a torque reactor.
Figure 1B:
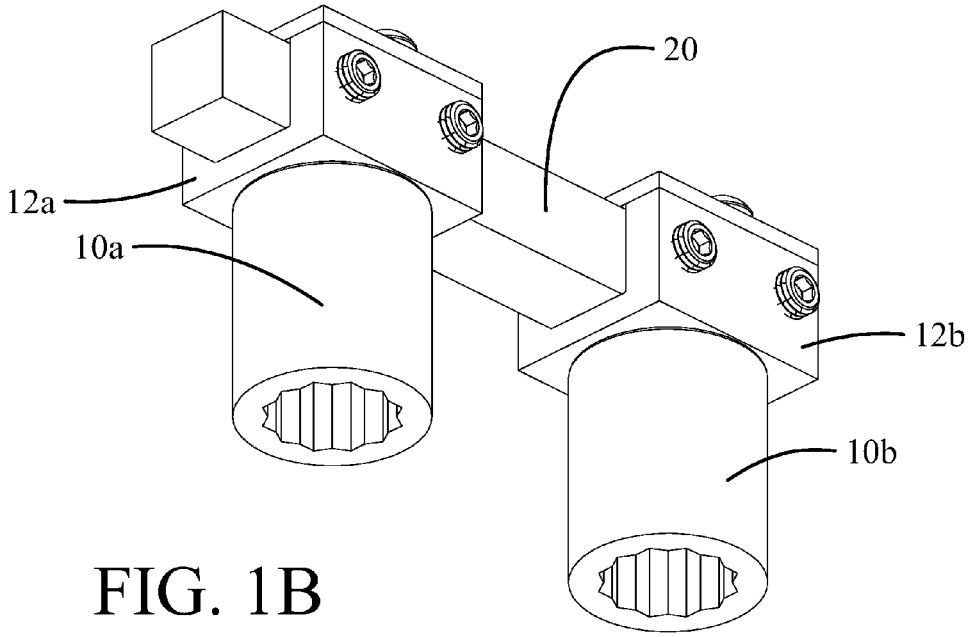
FIG. 1B is a lower pictorial depiction of the first embodiment.
Figure 1C:
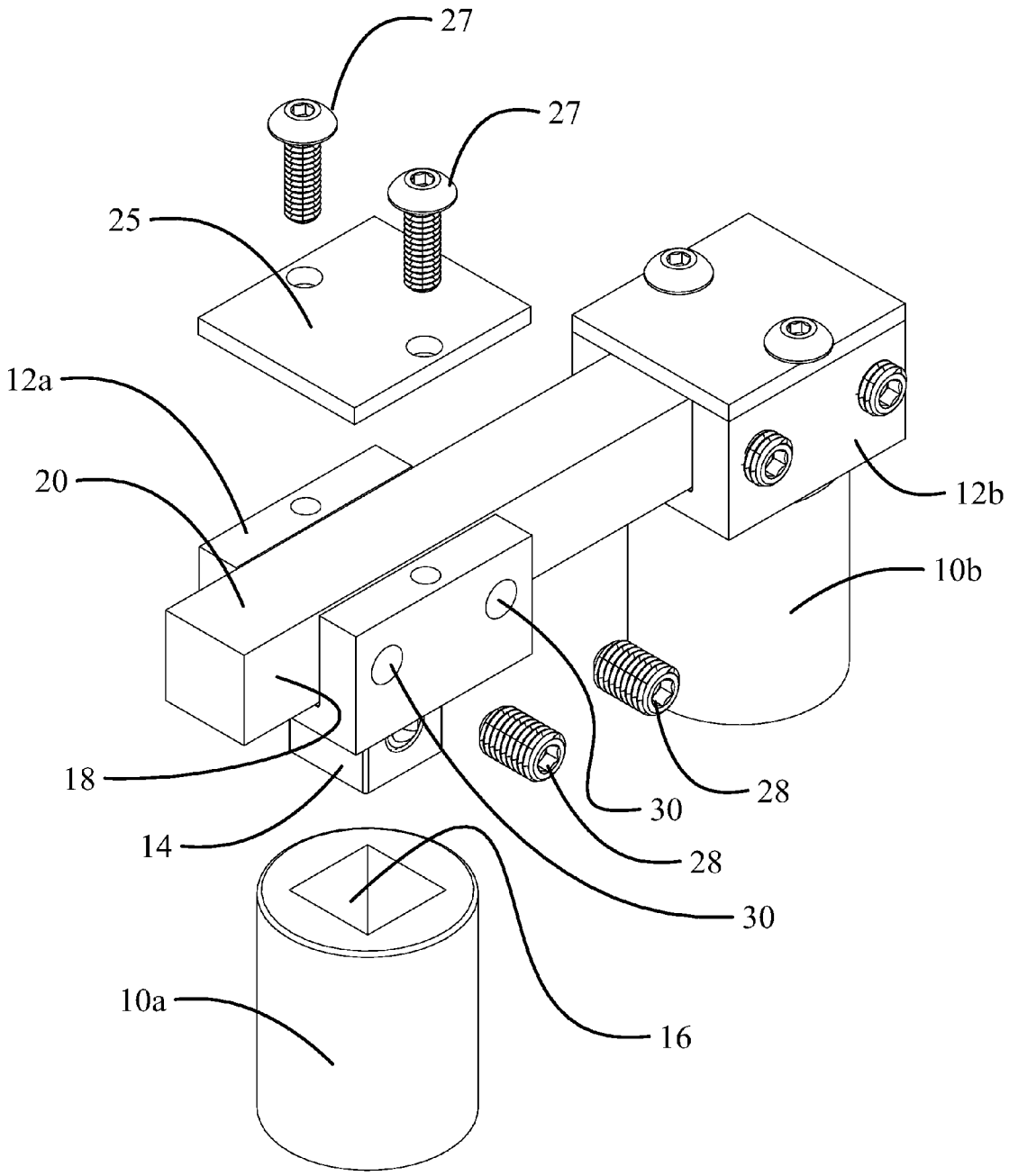
FIG. 1C is a partially exploded view of the first embodiment.
Figure 1D:
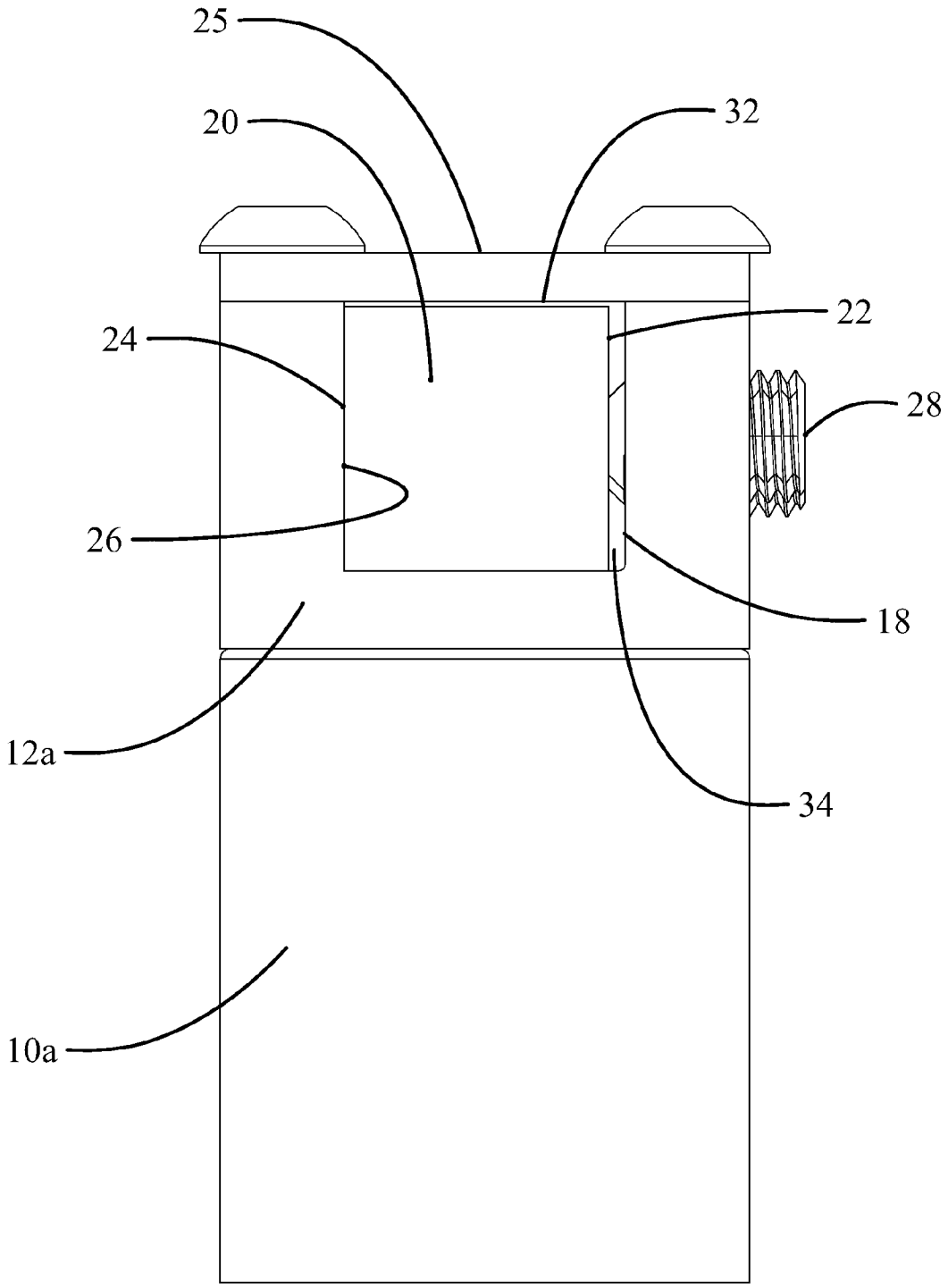
FIG. 1D is an end view of the first embodiment.

Referring to the drawings, FIGS. 1A and 1B show pictorial depictions and FIG. 1C an exploded view of a first embodiment of the torque reactor. First and second sockets 10*a* and 10*b* are configured to engage a first fastener element and an adjacent fastener element. First and second drive elements 12*a* and 12*b* are provided to engage the sockets 10*a*, 10*b*. For the embodiment shown the engagement is a square drive 14 received in a square relief 16 in each socket 10*a*, 10*b* as seen in FIG. 1C. Those skilled in the art will recognize alternative drive configurations for the drive elements and sockets. Each drive element 12*a*, 12*b* has a channel 18 which is sized to receive a shaft 20. For the exemplary embodiment, the shaft 20 has a square or rectangular cross section and the channels 18 are quadrilateral in shape to receive the shaft. For the assembled torque reactor as shown in FIG. 1D, the shaft 20 has a first face 22 against which a restraining element of an engagement mechanism may exert force as will be described in greater detail subsequently. A second face 24 on the shaft 20 is urged against a reacting face 26 in the channel 18 as seen in FIG. 1D to frictionally secure the drive element on the shaft. The shaft 20 is retained in the channel 18 of the drive elements 12*a*, 12*b* with a cap plate 25 engaged to the drive elements. For the embodiment shown, bolts 27 secure the cap plates 25 to the drive elements 12*a*, 12*b*. While shown in the embodiment with two movable drive elements for maximum flexibility in adjustment, one drive element could be fixed to the shaft in alternative embodiments. Additionally, while a cap plate is shown alternative methods for capturing the shaft in the drive elements may be employed which would eliminate the need for a cap.

Figure 1E:
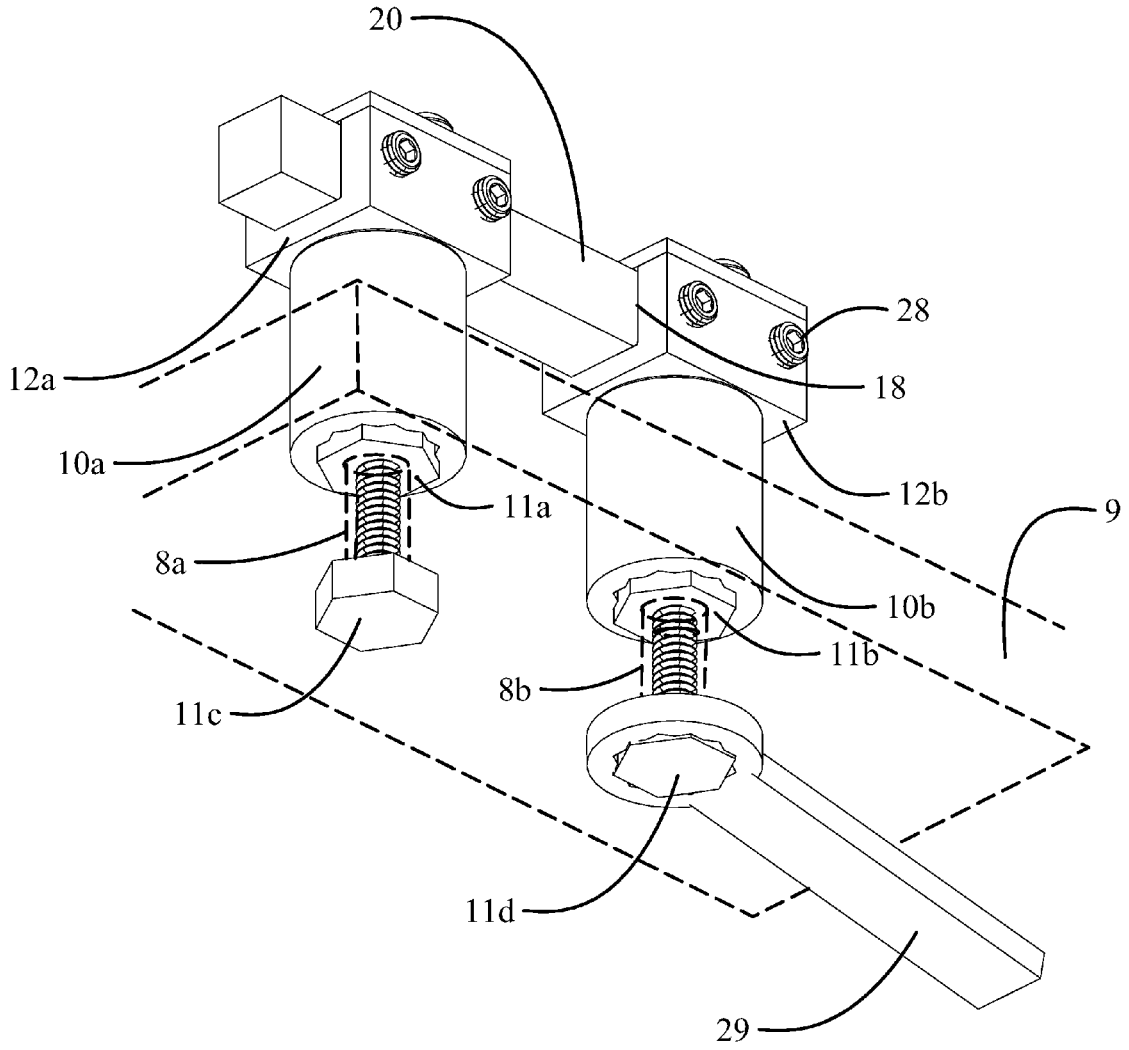
FIG. 1E is a pictorial depiction of the first embodiment attached to fasteners for use.

For the first embodiment, the restraining element employs set screws 28 received through threaded bores 30 in the drive elements 10*a*, 10*b*. The shaft 20 is received in channel 18 with sufficient play (as represented by vertical gap 32 and lateral gap 34 for the first embodiment) to allow relaxation of the shaft within the channel for translation of the drive elements 12*a*, 12*b* longitudinally along the shaft 20 for repositioning and for relief of any preload induced by torque of fastener elements in the sockets 10*a*, 10*b*. In use, the sockets 10*a*, 10*b* are engaged on the fastener elements, shown in the exemplary embodiment as fastener nuts 11*a*, 11*b* which engage fastener bolts 11*c*, 11*d* inserted through bores 8*a* and 8*b* in structure 9, shown in phantom, in FIG. 1E, and set screws 28 are tightened and urged against first face 22 of the shaft 20, in turn urging the shaft 20 laterally to frictionally engage second face 24 against the reacting face 26 in the channel 18 to prevent motion of the drive elements 12*a*, 12*b* and attached sockets 10*a*, 10*b* along the shaft 20. After completion of tightening of the fasteners, for example with wrench 29, any preload induced in the sockets 10*a*, 10*b* is released by withdrawing the set screws 28 allowing the drive elements 12*a*, 12*b* play on the shaft 20. The torque reactor may then be removed from the fasteners. While two set screws are shown in each drive element for the embodiment in the drawings, a single set screw in each drive element may be employed. Dimensions of the elements of the embodiment in the drawings have been selected for clarity. The overall height of the torque reactor is limited only by sufficient depth in the sockets 10*a*, 10*b* to receive the fastener element and cross section of the shaft 20 and resulting depth of drive elements 12*a*, 12*b* to structurally react resulting torques. Consequently the overall torque reactor may employ a very low profile enabling use in very compact working spaces.

Figure 2A:
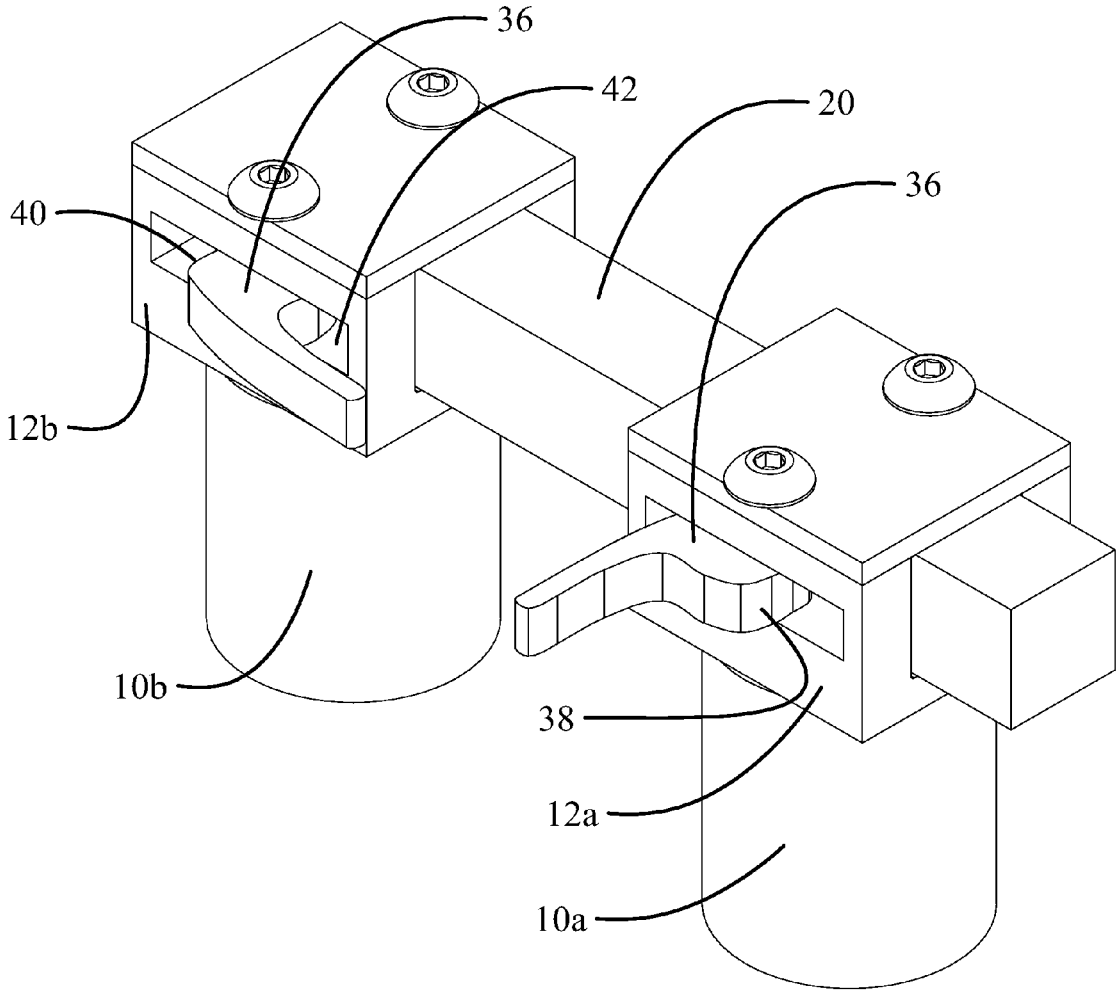
FIG. 2A is an upper pictorial depiction of a second embodiment.
Figure 2B:
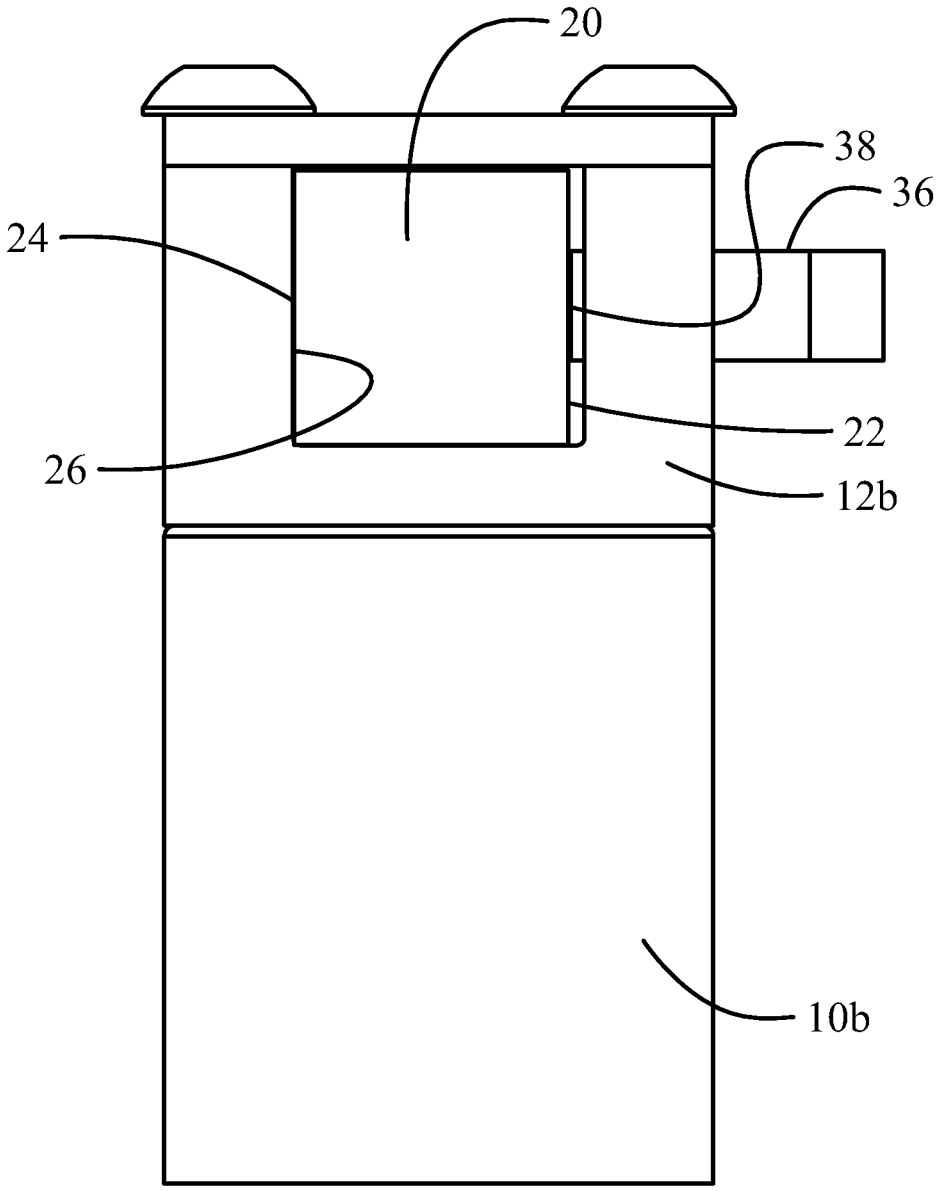
FIG. 2B is a first end view of the second embodiment.
Figure 2C:
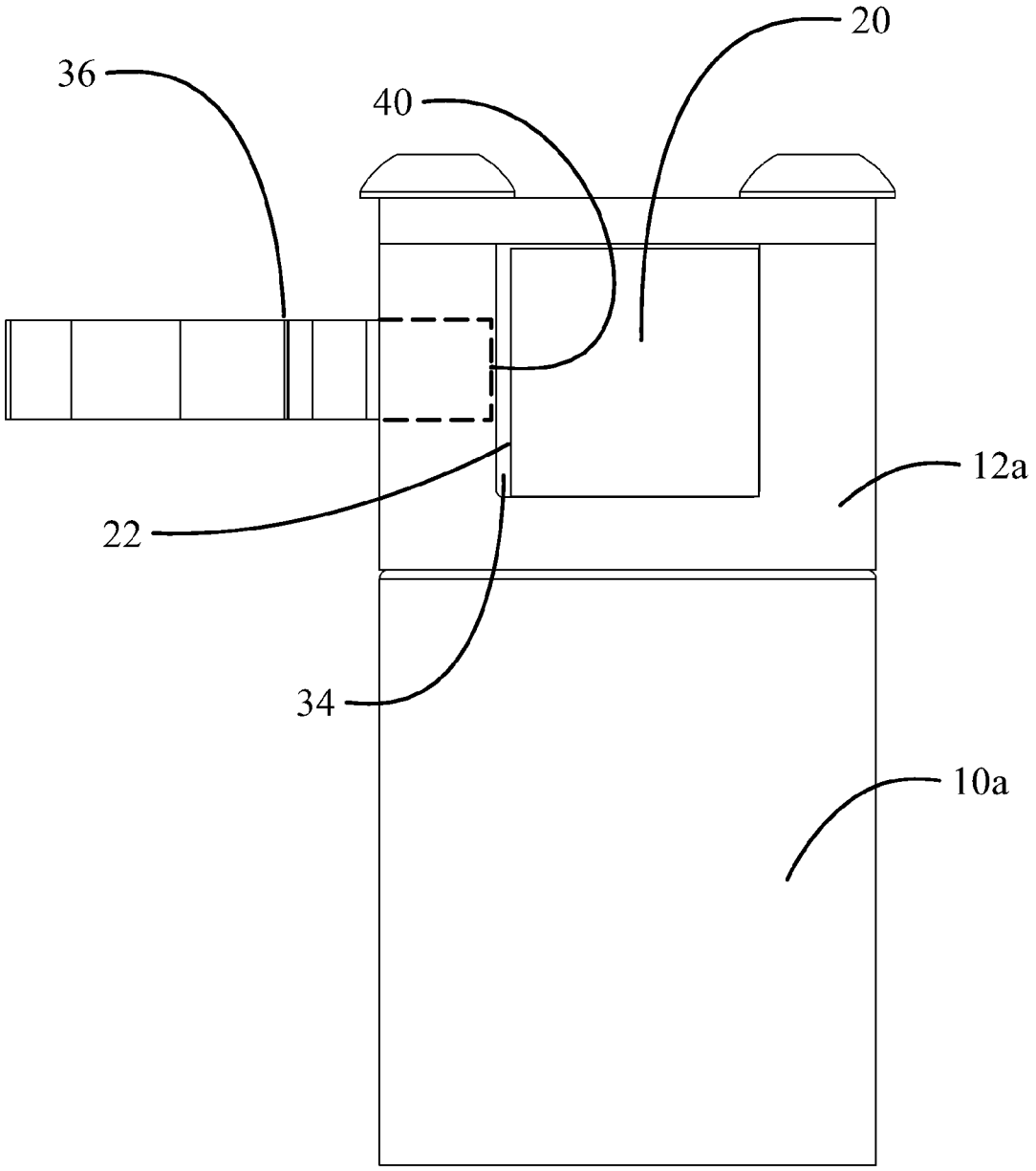
FIG. 2C is an opposite end view of the second embodiment.

An alternative restraining element is disclosed in a second embodiment shown in FIGS. 2A-2C. An overcenter cam 36 having a securing face 38 and a releasing face 40 may be rotatably mounted in a slot 42 in each of the drive elements 12*a*, 12*b*. A lever arm 44 extending from each cam 36 is employed to rotate the cam from an engaged position urging the securing face 38 against the shaft 20 to a released position allowing free play of the shaft within channel 18. The cams 36 are shown in drive element 12*a* in the released position and drive element 12*b* in the engaged position in FIG. 2A. As seen in FIG. 2B for the engaged position, cam 36 has securing face 38 urged against first face 22 of the shaft 20, in turn urging the shaft 20 laterally to frictionally engage second face 24 against the reacting face 26 in the channel 18 to prevent motion of the drive elements 12*a*, 12*b*. As in the first embodiment, after completion of tightening of the fasteners, any preload induced in the sockets 10*a*, 10*b* is released by rotating the cams 36 with the releasing face 40 adjacent the shaft 20 thereby allowing the drive elements 12*a*, 12*b* play on the shaft 20 with gap 34 as seen FIG. 2C. The torque reactor may then be removed from the fasteners.

Figure 3A:
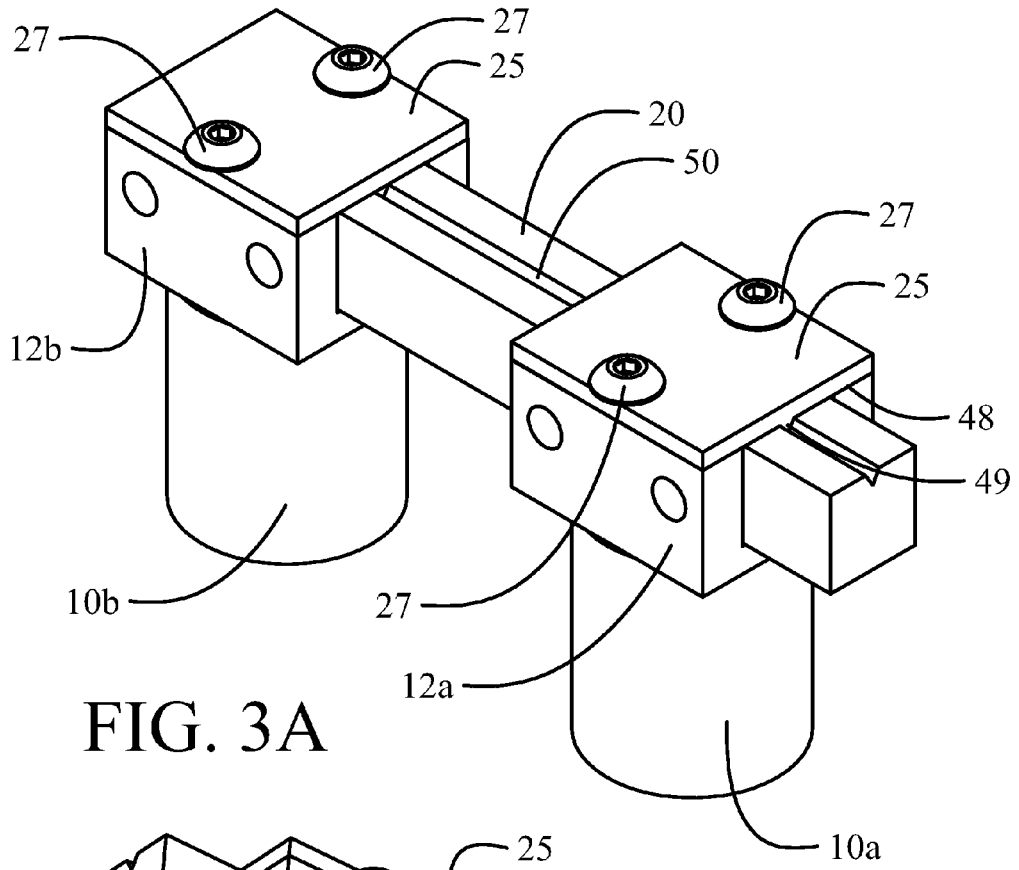
FIG. 3A is an upper pictorial depiction of a third embodiment.
Figure 3B:
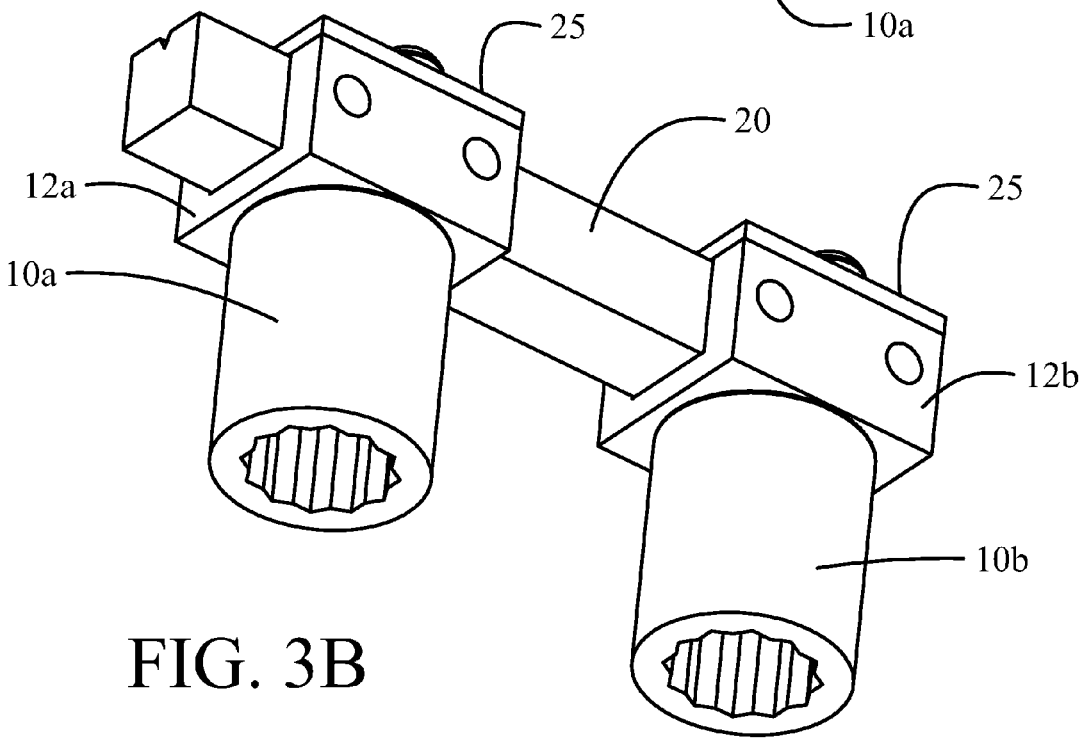
FIG. 3B is a lower pictorial depiction of the third embodiment.
Figure 3C:
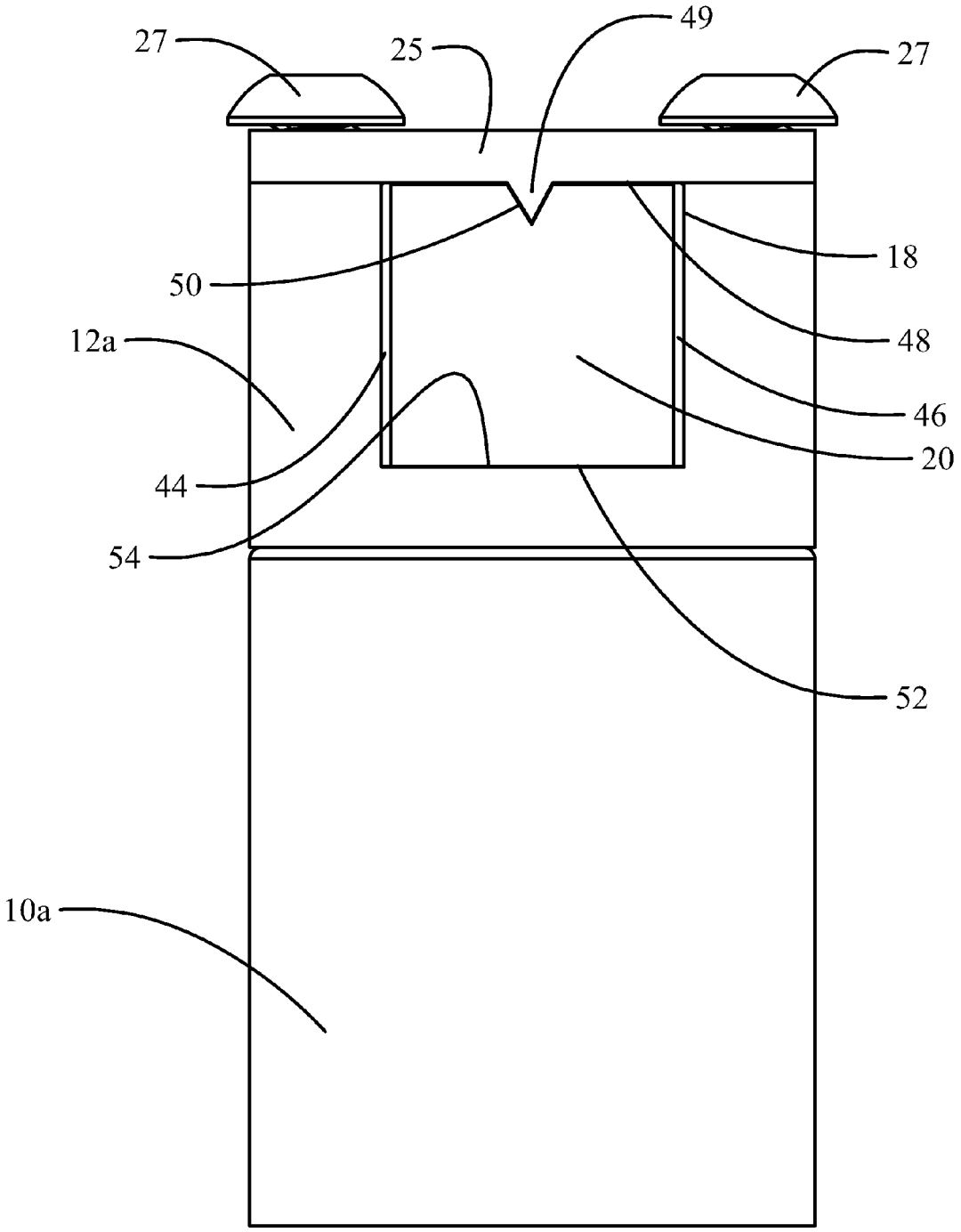
FIG. 3C is an end view of the third embodiment.

A third embodiment for lower torque applications is shown in FIGS. 3A-3C. As a simplification, cap plate 25 may be employed as the restraining element. The shaft 20 is received in channel 18 with sufficient play (as represented by vertical gaps 44 and 46) to allow relaxation of the shaft within the channel for translation of the drive elements 12*a*, 12*b* longitudinally along the shaft 20 for repositioning and for relief of any preload induced by torque of fastener elements in the sockets 10*a*, 10*b*. Each cap plate 25 incorporates a key 49 extending from a bottom surface 48 to be received in a groove 50 in the shaft 20. In use, the sockets 10*a*, 10*b* are positioned on the fastener elements and bolts 27 are tightened and urging key 49 on the bottom surface 48 of the cap plate 25 into the groove 50 of the shaft 20, additionally urging the shaft 20 vertically downward to frictionally engage bottom face 52 against bottom face 54 of the channel 18. The bottom face and groove each provide a reacting face to prevent motion of the drive elements 12*a*, 12*b* and attached sockets 10*a*, 10*b* along the shaft 20. After completion of tightening of the fasteners, any preload induced in the sockets 10*a*, 10*b* is released by withdrawing the bolts 27 allowing the drive elements 12*a*, 12*b* play on the shaft 20. The torque reactor may then be removed from the fasteners. While shown in the embodiment as a triangular key and groove, key 49 and groove 50 may have alternative geometric cross sections. This embodiment requires additional vertical clearance over the prior embodiments in the use application for access to the bolts 27. The first and second embodiments may provide a lower profile in compact working spaces.

Figure 4A:
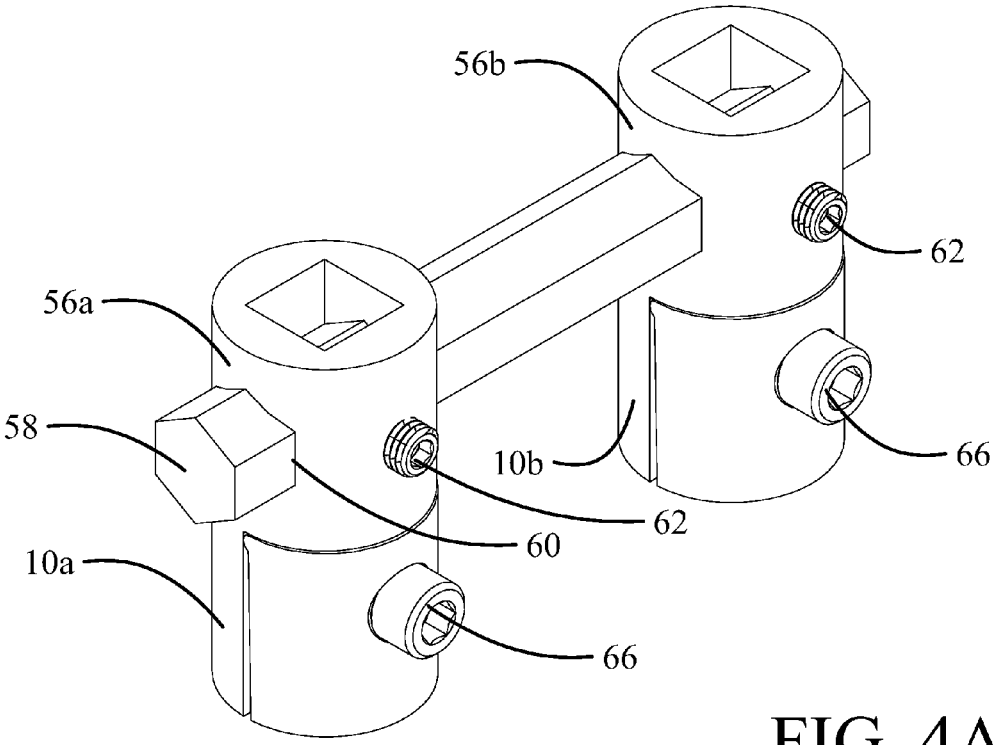
FIG. 4A is an upper pictorial depiction of a fourth embodiment.
Figure 4B:
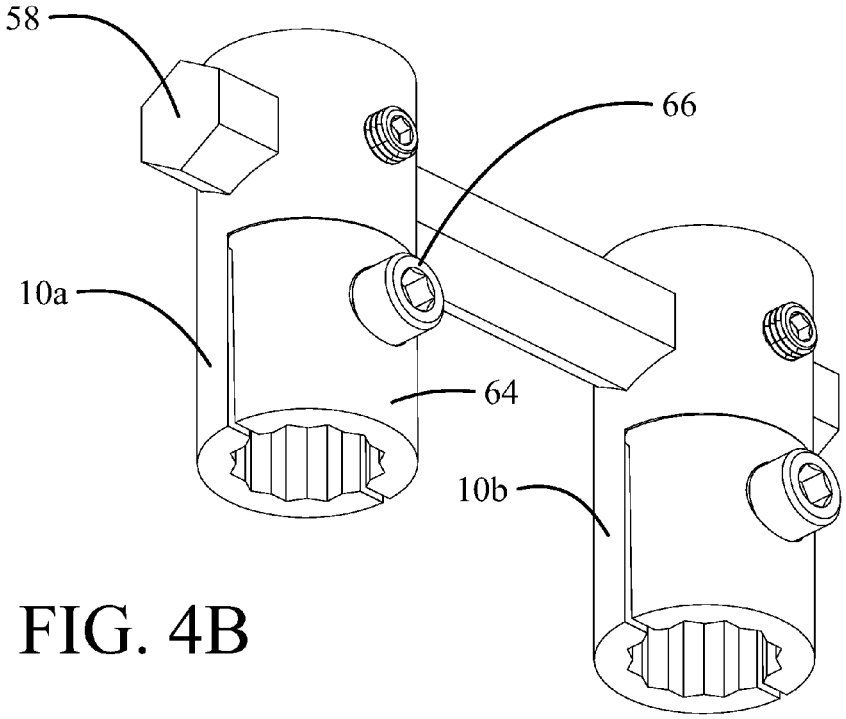
FIG. 4B is a lower pictorial depiction of the fourth embodiment.
Figure 4C:
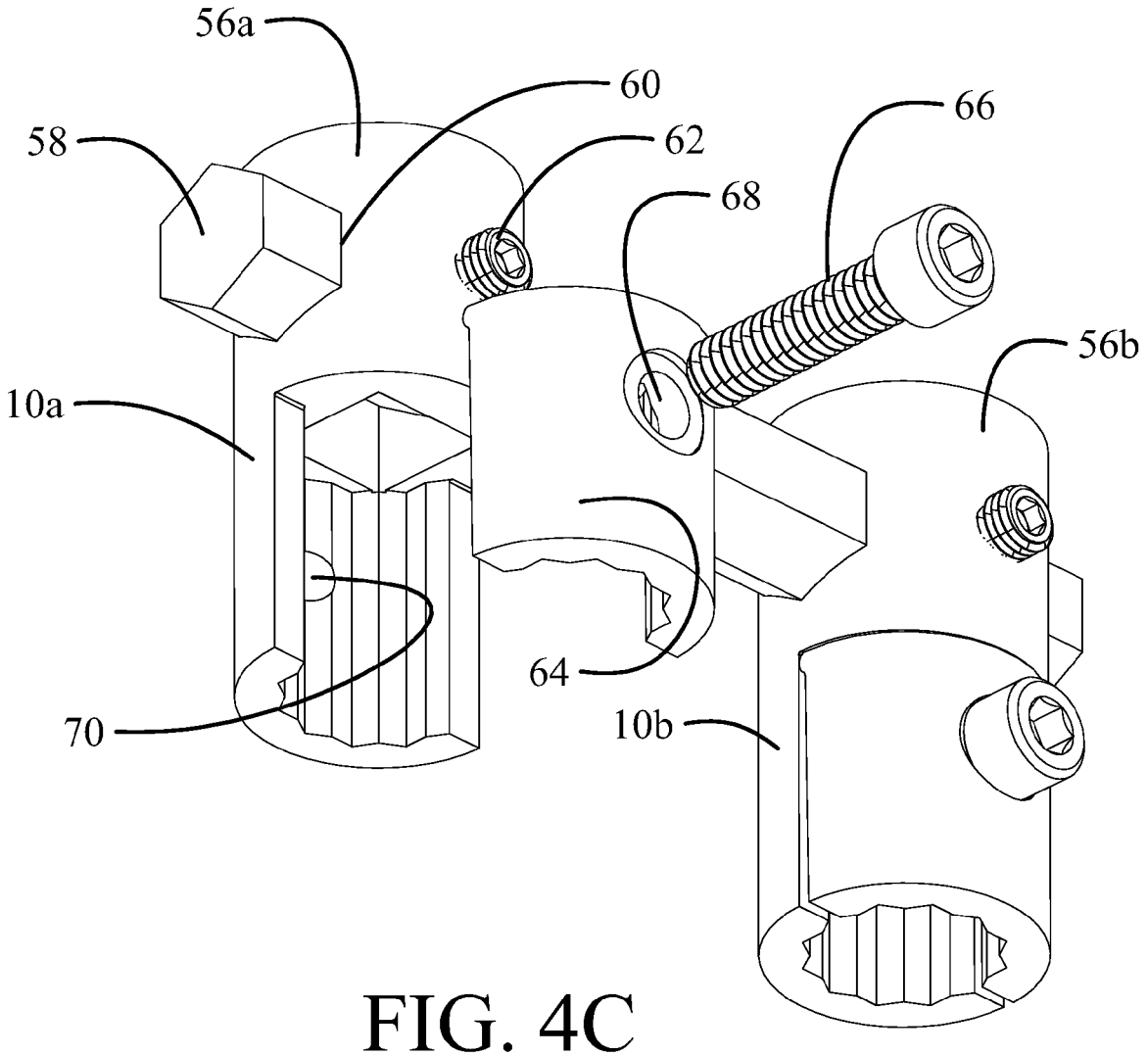
FIG. 4C is partially exploded view of the fourth embodiment.

A fourth embodiment of the torque reactor is shown in FIGS. 4A-4C employing restraining elements having multiple features. For this embodiment, drive elements 56*a* and 56*b* are integral to sockets 10*a*, 10*b* extending as an upper portion of the sockets. Shaft 58 is slidably engaged through an aperture 60 in each of the drive elements 56*a*, 56*b* and is releasably secured with set screws 62 providing a first feature of the restraining element. In each socket 10*a*, 10*b* a removable bifurcated segment 64 is attached with a bolt 66 acting as a second feature of the restraining element. The bolt 66 is received through an aperture 68 in the segment 64 and secured in a threaded bore 70 in the socket as seen in FIG. 4C. In use, the segments 64 are secured in the sockets 10*a*, 10*b* by tightening bolts 66. The sockets 10*a*, 10*b* are then adjusted to a desired spacing to engage adjacent fasteners by sliding drive elements 56*a*, 56*b* along shaft 58 and securing the shaft with set screws 62. After torqueing of the fasteners if a preload has been induced, bolts 66 are loosened releasing the segments 64 to allow removal of the torque reactor from the fasteners. In an alternative form of this embodiment, the segments may extend into the drive elements and a single securing bolt may replace the set screw 62 and bolt 66 for engaging the shaft and mating the segment to the socket.

For the first three embodiment described herein a quadrilateral shaft is employed with the shaft of the fourth embodiment employs a hexagonal cross section. In alternative embodiments, any geometric cross section providing engaging surfaces for the restraining elements and the receiving channel or aperture.

Figure 5:
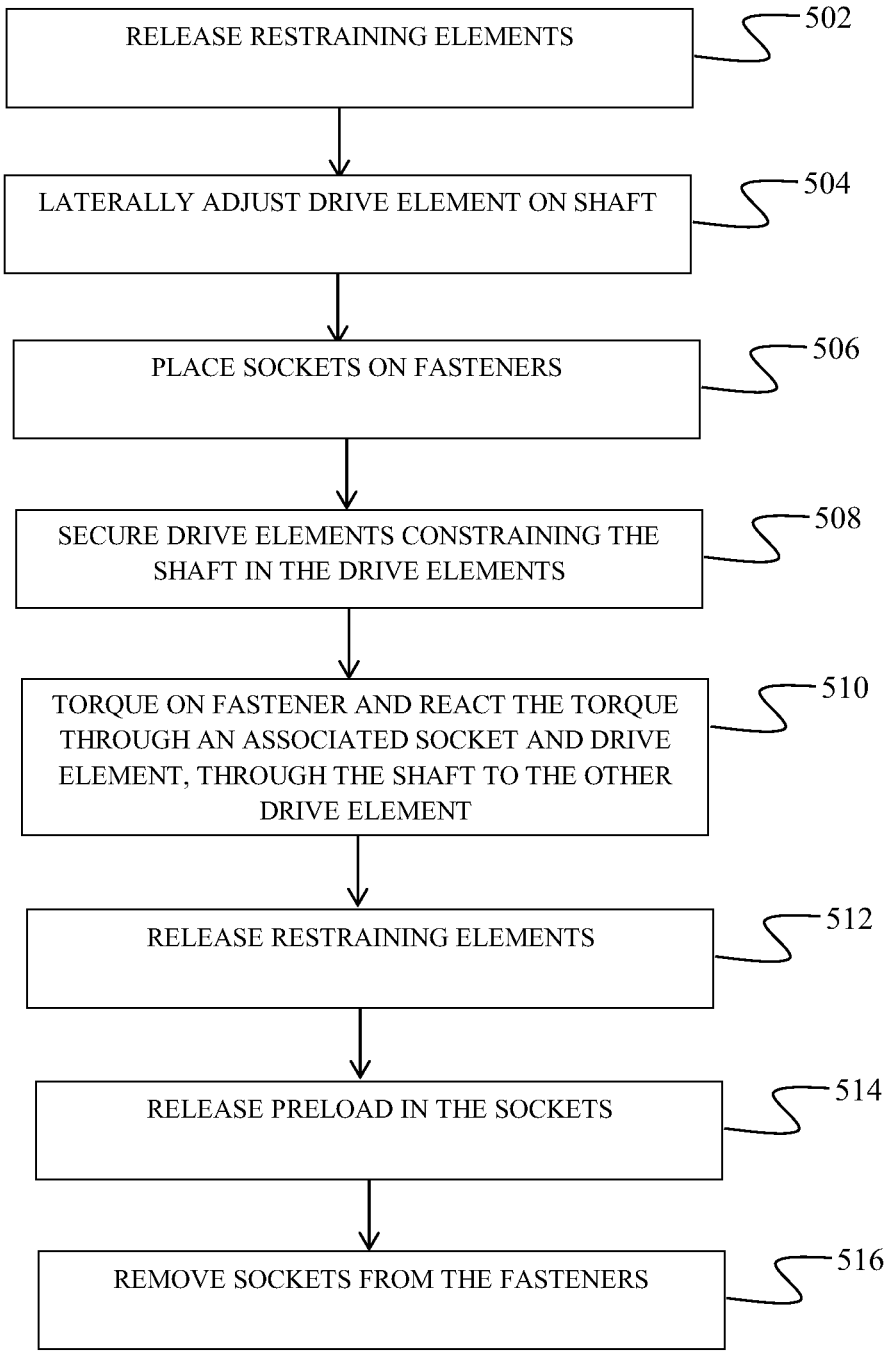
FIG. 5 is a flow chart showing a method reacting torque during fastener installation employing the embodiments disclosed herein.

A method for reacting torque during fastener installation using the embodiments disclosed herein is shown in FIG. 5 and described with respect to the embodiment of FIGS. 1A-1D as exemplary. Restraining elements, for example set screws 28, in drive elements 12*a*, 12*b* are released, step 502, and the drive elements 12*a*, 12*b* are laterally adjusted, step 504, on the shaft 20 to be equivalent to spacing of fasteners onto which sockets 10*a*, 10*b* are placed, step 506. As noted with respect to the first embodiment only one of the drive elements needs to be positionable but both are identified as moving for maximum flexibility in use. The restraining elements in drive elements 12*a*, 12*b* are then secured, step 508 constraining the shaft in the drive elements 12*a*, 12*b*. Torqueing of one of the fasteners is transmitted in associated socket 10*a* through the associated drive element 12*a* and shaft 20 to the other drive element 12*b* and socket 10*b* secured to the adjacent fastener employing the arm length of the shaft 20 between the drive elements 12*a*, 12*b* for mechanical advantage to react the torque, step 510. Upon completion of torqueing the fastener, the restraining elements are released, step 512, thereby allowing any preload established in the sockets 10*a*, 10*b* to be released, step 514. The sockets 10*a*, 10*b* may then be removed from the fasteners, step 516.

Figure 6:
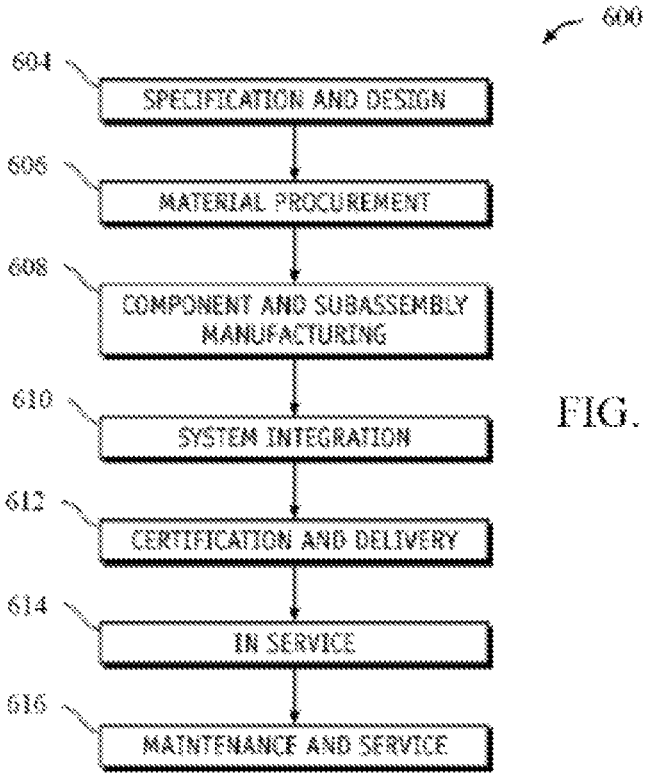
FIG. 6 is a flow chart depicting an aircraft manufacturing and service method in which the disclosed embodiments may be employed; and, FIG. 7 is a flow chart depicting an aircraft with which the disclosed embodiments may be employed.
Figure 7:
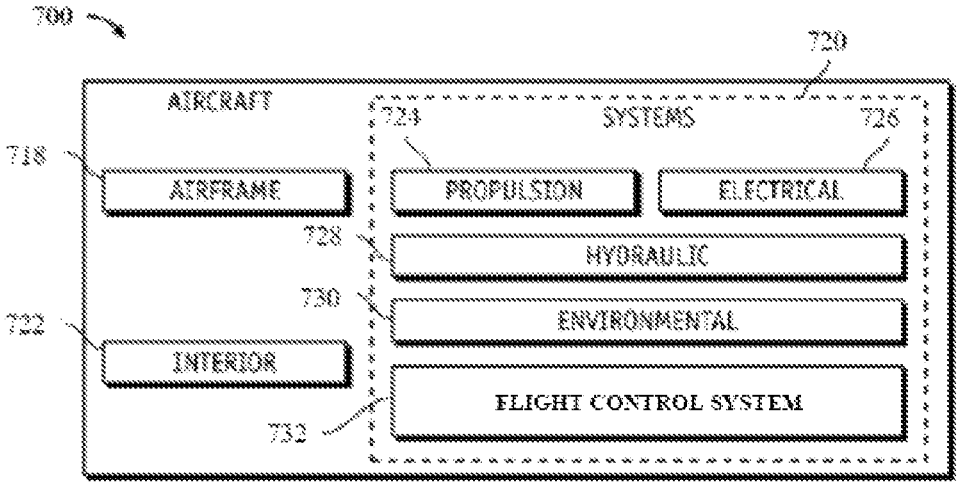

Embodiments of the disclosure may be employed in the context of an aircraft manufacturing and service method 600 (method 600) as shown in FIG. 6 and an aircraft 700 as shown in FIG. 7. During pre-production, the exemplary method 600 may include specification and design 604 of the aircraft 700 and material procurement 606. During production, component and subassembly manufacturing 608 and system integration 610 of the aircraft 700 takes place. Thereafter, the aircraft 700 may go through certification and delivery 612 in order to be placed in service 614. While in service by a customer, the aircraft 700 is scheduled for routine maintenance and service 616 (which may also include modification, reconfiguration, refurbishment, and so on).

Each of the processes of method 600 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be without limitation an airline, leasing company, military entity, service organization, and the like.

As shown in FIG. 7, the aircraft 700 produced by the exemplary method 600 may include an airframe 718 with a plurality of systems 720 and an interior 722. Examples of high-level systems 720 include one or more of a propulsion system 724, an electrical system 726, a hydraulic system 728, an environmental system 730, and flight control system 732. Any number of other systems may also be included. Although an aerospace example is shown, the embodiments of the disclosure may be applied to other industries.

Apparatus and methods embodied herein and previously described may be employed during any one or more of the stages of the production and service method 600. For example, components or subassemblies corresponding to production process 608 may be fabricated or manufactured in a manner similar to components or subassemblies produced while the aircraft 700 is in service. In addition, one or more apparatus embodiments as described herein, method embodiments described herein, or a combination thereof may be utilized during the production stages 608 and 610, for example, by substantially expediting assembly of or reducing the cost of an aircraft 700. Similarly, one or more of apparatus embodiments, method embodiments, or a combination thereof may be utilized while the aircraft 700 is in service, for example and without limitation, to maintenance and service 616.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A torque reactor comprising:

a first socket configured to engage a fastener element;

a first drive element engaging the first socket, said first drive element having a first receiving channel;

a second socket configured to engage a second fastener element;

a second drive element engaging the second socket, said second drive element having a second receiving channel;

a shaft received with a lateral gap in the first receiving channel and in the second receiving channel;

a first releasable engagement mechanism urging a face of the shaft against a reacting face of the first receiving channel frictionally securing the shaft in the first receiving channel, thereby preventing motion of the first drive element longitudinally along the shaft when secured; and, a second releasable engagement mechanism urging the face of the shaft against a reacting face of the second receiving channel frictionally securing the shaft in the second receiving channel, thereby preventing motion of the second drive element longitudinally along the shaft when secured;

said first releasable engagement mechanism and said second releasable engagement mechanism allowing relaxation of the shaft within the channel for translation of the drive elements longitudinally along the shaft and lateral translation of the shaft in the lateral gap relieving induced preload in the first and second socket when released.

2. The torque reactor as defined in claim 1 wherein the first and second engagement mechanisms each comprise at least one set screw received through a threaded bore to engage a first face of the shaft urging a second face of the shaft laterally upon tightening to engage a reacting face of the receiving channel thereby locking the shaft in the channel.

3. The torque reactor as defined in claim 2 wherein loosening of the at least one set screw releases the shaft thereby allowing longitudinal adjustment of the first and second drive elements on the shaft.

4. The torque reactor as defined in claim 2 wherein loosening of the at least one set screw releases the shaft thereby releasing preload on the sockets induced by torqueing of a fastener engaged by one of the first or second socket.

5. The torque reactor as defined in claim 1 wherein the first and second engagement mechanisms each comprise an overcenter cam having a securing face and a releasing face rotatably mounted in a slot in each of the drive elements.

6. The torque reactor as defined in claim 5 wherein rotation of the cam to an engaged position urges the securing face against the a first face of the shaft urging a second face of the shaft laterally upon to engage a reacting face of the receiving channel thereby locking the shaft in the channel.

7. The torque reactor as defined in claim 5 wherein rotation of the cam with the releasing face adjacent the shaft releases the shaft thereby allowing longitudinal adjustment of the first and second drive elements on the shaft.

8. The torque reactor as defined in claim 5 wherein rotation of the cam with the releasing face adjacent the shaft releases the shaft thereby releasing preload on the sockets induced by torqueing of a fastener engaged by one of the first or second socket.

9. The torque reactor as defined in claim 1 wherein each of said first and second sockets incorporate a bifurcated segment and each of said first and second drive elements are integral with the first and second sockets, said shaft is slidably engaged through an aperture in each of the drive elements and is releasably secured with a set screw and said engagement mechanism includes a bolt received through an aperture in each bifurcated segment and secured in a threaded bore.

10. The torque reactor as defined in claim 9 wherein loosening of the set screws releases the shaft thereby allowing longitudinal adjustment of the first and second drive elements on the shaft.

11. The torque reactor as defined in claim 9 wherein loosening of the bolts releases bifurcated segments thereby releasing preload on the sockets induced by torqueing of a fastener engaged by one of the first or second socket.

12. A torque reactor comprising:

a first socket configured to engage a fastener element;

a first drive element engaging the first socket, said first drive element having a first receiving channel;

a second socket configured to engage a second fastener element;

a second drive element engaging the second socket, said second drive element having a second receiving channel;

a shaft received in the first receiving channel and received in the second receiving channel;

a first engagement mechanism securing the shaft in the first receiving channel; and, a second engagement mechanism securing the shaft in the second receiving channel, wherein the first and second engagement mechanisms each comprise a cap plate having a key releasably engaged on each drive element with bolts, said cap plate key engaging a groove in a top surface of the shaft urging a bottom face of the shaft vertically upon tightening to engage a bottom surface of the receiving channel, said groove and bottom surface as reacting faces thereby locking the shaft in the channel.

13. The torque reactor as defined in claim 12 wherein loosening of the bolts releases the shaft thereby allowing longitudinal adjustment of the first and second drive elements on the shaft.

14. The torque reactor as defined in claim 12 wherein loosening of the bolts releases the shaft thereby releasing preload on the sockets induced by torqueing of a fastener engaged by one of the first or second socket.

15. A method for reacting torque during torqueing of a fastener comprising:

releasing restraining elements in at least one of a first drive element having a first receiving channel and a second drive element having a second receiving channel from a shaft received in the first and second receiving channels with a lateral gap;

longitudinally adjusting the drive elements on the shaft to be equivalent to spacing of fasteners onto which first and second sockets are to be placed;

placing the first and second sockets on a fastener and an adjacent fastener;

securing the restraining elements in the first and second drive elements constraining the shaft in the drive elements;

torqueing the fastener;

transmitting the torque in the first socket through the first drive element and shaft to the second drive element and second socket secured to the adjacent fastener employing the arm length of the shaft between the drive elements for mechanical advantage to react the torque; and, upon completion of torqueing the fastener, releasing the restraining elements allowing lateral translation of the shaft in a lateral gap thereby releasing any preload established in the sockets.

16. The method as defined in claim 15 further comprising removing the sockets from the fasteners.

17. The method as defined in claim 15 wherein the restraining elements each comprise at least one set screw received through a threaded bore and the step of securing the restraining elements comprises tightening the at least one set screw to engage a first face of the shaft urging a second face of the shaft laterally to engage a reacting face of the receiving channel thereby locking the shaft in the channel and wherein the step of releasing the restraining elements comprises loosening the at least one set screw.

18. The method as defined in claim 15 wherein the restraining elements each comprise an overcenter cam having a securing face and a releasing face rotatably mounted in a slot in each of the drive elements and the step of securing the restraining elements comprises rotating the cam to an engaged position thereby urging the securing face against the a first face of the shaft urging a second face of the shaft laterally upon to engage a reacting face of the receiving channel locking the shaft in the channel and wherein the step of releasing the restraining elements comprises rotating the cam with the releasing face adjacent the shaft.

19. The method as defined in claim 15 wherein the restraining elements each comprise a cap plate having a key, said cap plate releasably engaged on each drive element with bolts, and the step of securing the restraining elements comprises engaging the cap plate key with a groove in a top surface of the shaft urging a bottom face of the shaft vertically upon tightening of the bolts to engage a bottom surface of the receiving channel, said bottom surface and groove as reacting faces thereby locking the shaft in the channel and wherein the step of releasing the restraining elements comprises loosening the bolts.

20. The method as defined in claim 15 wherein the first and second sockets each include a bifurcated segment and the restraining elements each include a bolt received through an aperture in each bifurcated segment and secured in a threaded bore and the drive elements each include an aperture receiving the shaft releasably secured with a set screw and the step of securing the restraining elements comprises tightening the set screws and the bolts and wherein the step of releasing the restraining elements comprises loosening the set screws and the bolts.

* * * * *